United States Patent [19]

Mahoney et al.

[11] 4,206,744

[45] Jun. 10, 1980

[54] AIR CONTROL ASSEMBLY FOR HEAT CIRCULATING FIREPLACE

[75] Inventors: Kenneth L. Mahoney, Fort Wayne, Ind.; David A. Johnson, Hayward, Calif.

[73] Assignee: American Standard Inc., New York, N.Y.

[21] Appl. No.: 856,712

[22] Filed: Dec. 2, 1977

[51] Int. Cl.[2] ..... F24B 7/00

[52] U.S. Cl. ..... 126/121; 126/131; 126/285 R

[58] Field of Search ..... 126/120, 121, 122, 129, 126/130, 131, 61, 66, 80, 89, 285 R, 293; 237/51; 165/16

[56] References Cited

U.S. PATENT DOCUMENTS

| | | | |
|---|---|---|---|
| 685,316 | 10/1901 | Williamson et al. | 126/285 R |
| 1,313,085 | 8/1919 | Greene | 126/121 |
| 1,646,307 | 10/1927 | Moffat | 126/121 |
| 1,980,109 | 11/1934 | Stockly | 165/16 |
| 2,120,977 | 6/1938 | Holz | 126/121 |
| 2,209,263 | 7/1940 | Gaines | 165/16 |
| 2,209,800 | 7/1940 | Terry | 165/16 |
| 2,231,258 | 2/1941 | Elmore | 126/121 |
| 2,235,022 | 3/1941 | Komroff | 165/16 |
| 2,362,526 | 11/1944 | Austin | 126/121 |
| 3,773,028 | 11/1973 | Schreibus | 431/14 |
| 3,897,773 | 8/1975 | Burt et al. | 126/285 R |
| 4,008,703 | 2/1977 | Allgood | 237/51 |
| 4,027,654 | 6/1977 | Kannapell | 126/285 R |
| 4,068,650 | 1/1978 | Nelson | 126/121 |

FOREIGN PATENT DOCUMENTS

| | | | |
|---|---|---|---|
| 152619 | 12/1954 | Fed. Rep. of Germany | 126/285 R |
| 21512 | of 1894 | United Kingdom | 126/288 |
| 1095644 | 12/1967 | United Kingdom | 126/121 |

*Primary Examiner*—Carroll B. Dority, Jr.
*Assistant Examiner*—Lee E. Barrett
*Attorney, Agent, or Firm*—James J. Salerno, Jr.; Robert G. Crooks

[57] ABSTRACT

This invention is directed to a heat circulating fireplace arranged and constructed to control the temperature in which air is delivered to an insert module and to control the temperature of the heated air discharged into the fireplace room and/or adjacent rooms. The fireplace includes an air control assembly operably coupled to an insert module which is adapted to be mounted into an existing fireplace or may be part of the original fireplace assembly. The air control assembly including damper means is associated with the fan means and is capable of proportioning outside air and/or room air into the insert module so as to maintain a predetermined temperature of heated air being discharged. The damper means is operable to control or proportion room air and/or outside air to maintain a desired temperature gradient between air to be heated and discharged air to the fireplace room and/or adjacent rooms. Air inlet ducts and heated air outlet ducts are coupled in fluid communication to the insert module. Fan means are adapted to be mounted in fluid communication with the air inlet ducts for conducting air to be heated through the insert module in heat exchange relation with the heat exchanger and the hot combustion gases. The heated air is conducted through the outlet ducts and discharged into the area adjacent to or remote from the fireplace.

4 Claims, 6 Drawing Figures

FIG. 5
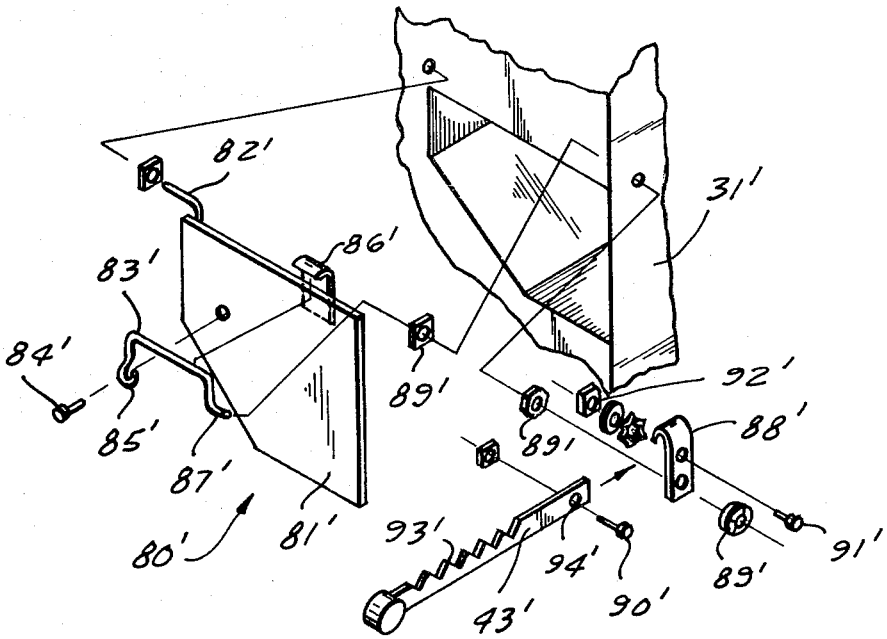
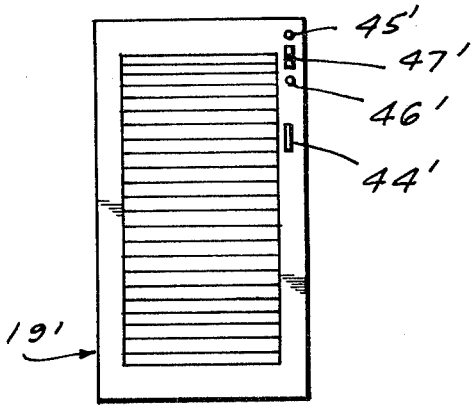
FIG. 6

AIR CONTROL ASSEMBLY FOR HEAT CIRCULATING FIREPLACE

RELATED APPLICATIONS

Co-pending application Ser. No. 856,713 directed to a fireplace design of Rodney Hempel and Clifton Briner for "Heat Circulating Fireplace," is concurrently filed herewith.

BACKGROUND OF THE INVENTION

1. Field of the Invention

The invention relates to an air control assembly for a fireplace construction which is capable of controlling the temperature at which the air is delivered to a heat exchanger and to control the temperature of heated air discharged to the fireplace room and/or adjacent rooms.

2. Description of the Prior Art

Fireplace designs which utilize the available heat from the burning fuel are known. Passages surrounding the hearth provide heat ducts which warms the air it passes therethrough. Others employ fan means in order to increase the circulation of air through the heat duct such as is described in U.S. Pat. No. 3,762,391. Also various designs of heat duct assemblies can be made to fit in an existing hearth of a fireplace, as shown in U.S. Pat. Nos. 3,880,141, 3,896,785, 3,995,611, 3,965,886 and 4,008,707.

SUMMARY OF THE INVENTION

It is an object of the invention to provide an air control assembly capable of utilizing room air and/or outside air to be heated in a fireplace assembly and discharging the heated air through heat circulating ducts coupled to a fireplace assembly and maintained at a desired predetermined temperature.

Another object of the invention is to provide an air control assembly adapted to be coupled to a heat circulating fireplace capable of supplying air to the fireplace room and/or adjacent rooms to be heated.

Yet another object of the invention is to provide damper means which is operable to control and proportion room air and/or outside air to maintain a desired temperature gradient between air to be heated and discharged heated air to the fireplace room and/or adjacent rooms.

Still another object of the invention is to provide variable temperatures of discharged heated air by utilizing the damper means to regulate the mass rate of flow between air passing through the fireplace heat exchanger in heat exchange relation with the combustion gases of the fire.

Another object of the invention is to provide an air control assembly for heat circulating fireplaces which is relatively easy to manufacture and assemble.

The invention generally contemplates providing an air control assembly for a heat circulating fireplace arranged and constructed to control the temperature at which air is delivered to an insert module and to control the temperature of heated air discharged into the fireplace room and/or adjacent rooms. The fireplace includes an air control assembly operably coupled to an insert module assembly which is adapted to be mounted in an existing fireplace or may be part of the original fireplace assembly. The air control assembly including damping means is associated with a fan and is capable of proportioning outside air and/or room air into the insert module to maintain a predetermined temperature of heated air being discharged. Air inlet ducts and heated air outlet ducts are coupled in fluid communication to the insert module. The damper means is operable to control or proportion room air and/or outside air to maintain a desired temperature gradient between air to be heated and discharged air. Fan means are adapted to be mounted in fluid communication with the air inlet ducts for conducting air to be heated through the insert module in heat exchange relation with the heat exchanger and the hot combustions gases. The heated air is conducted through the outlet ducts to be discharged into the area adjacent to or remote from the fireplace.

BRIEF DESCRIPTION OF THE DRAWINGS

FIG. 5 is an exploded isometric view of the damper assembly shown operably mounted in FIG. 3; and FIG. 6 is an elevational view of the grille for mounting on the air inlet opening of the air control assembly shown in FIG. 2.

DESCRIPTION OF THE PREFERRED EMBODIMENT

Figure 1:
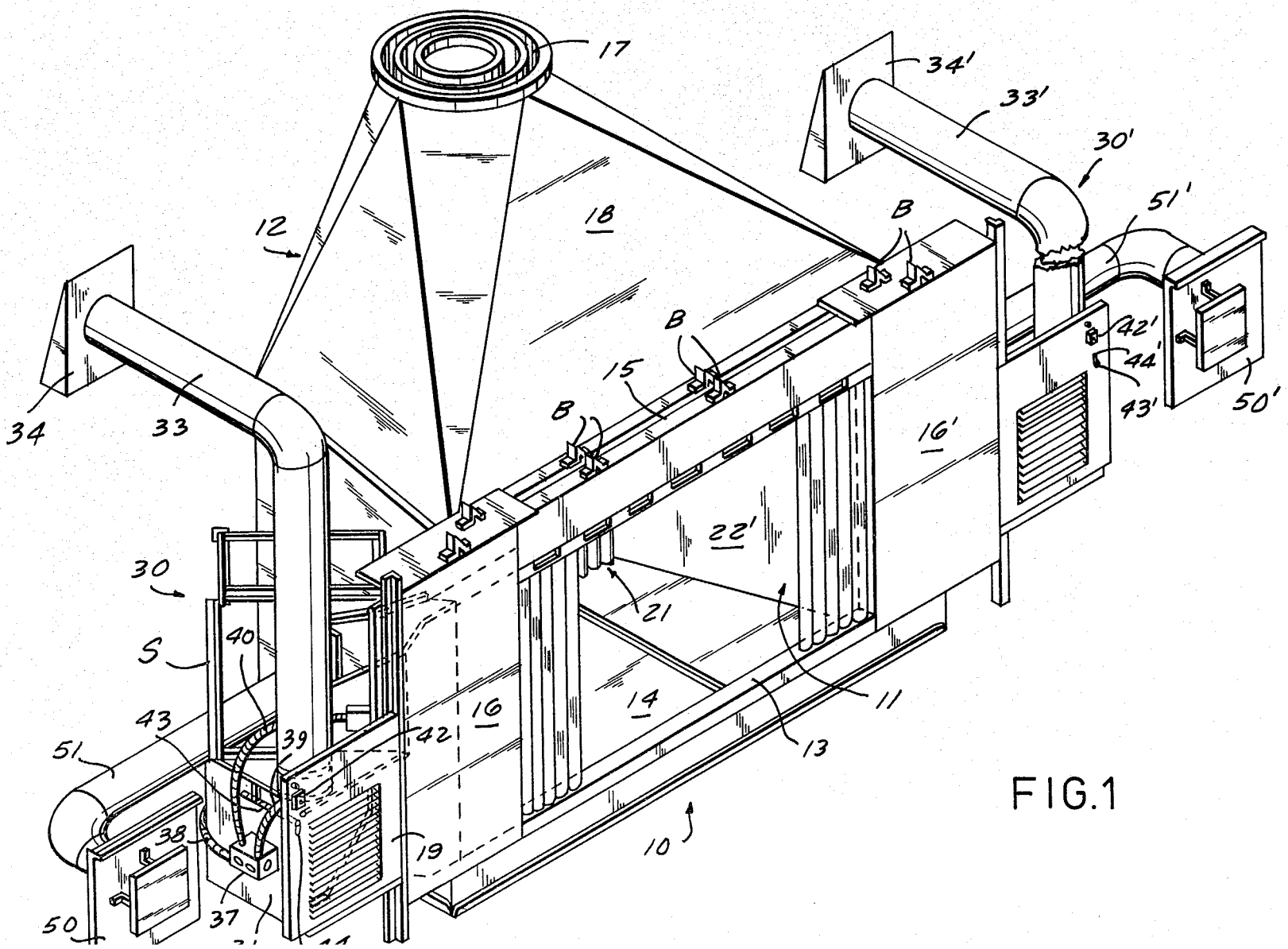
FIG. 1 is an isometric view of the assembly of a heat circulating fireplace of one form of the invention.

The present invention is illustrated in the accompanying Figs. wherein similar components are indicated by the same reference numerals throughout the several views and where pairs of components are used, the component is referenced by prime of the reference numeral.

Referring to FIG. 1 which illustrates a prefabricated fireplace assembly 10, in isometric view of the invention herein, and comprises a prefabricated fireplace 12 substantially as described in U.S. Pat. No. 2,821,975. The fireplace includes a combustion chamber 14, having an intermediate fireplace casing 17 surrounding combustion chamber 14 and spaced therefrom and the outer fireplace casing 18 which in turns surrounds the intermediate fireplace casing 17 and is spaced therefrom so as to leave an air space between them. Fireplace assembly 10 is coupled to a thermosiphonic chimney, not shown, having certain features in common with the chimney of U.S. Pat. No. 2,634,279. The thermosiphonic chimney carries combustion products away from the fireplace and also provides an air stream which cools the fire box of the fireplace as well as the flue and other members of the thermosiphonic chimney.

Mounted in the front of fireplace 10 is a closure assembly 11 which includes a hearth extension 13, top panel 15, and a pair of side panel grilles 16, 16'. A sliding metal screen is mounted between the side panel grilles 16, 16' which opens and closes the opening of combustion chamber 14.

Figure 2:
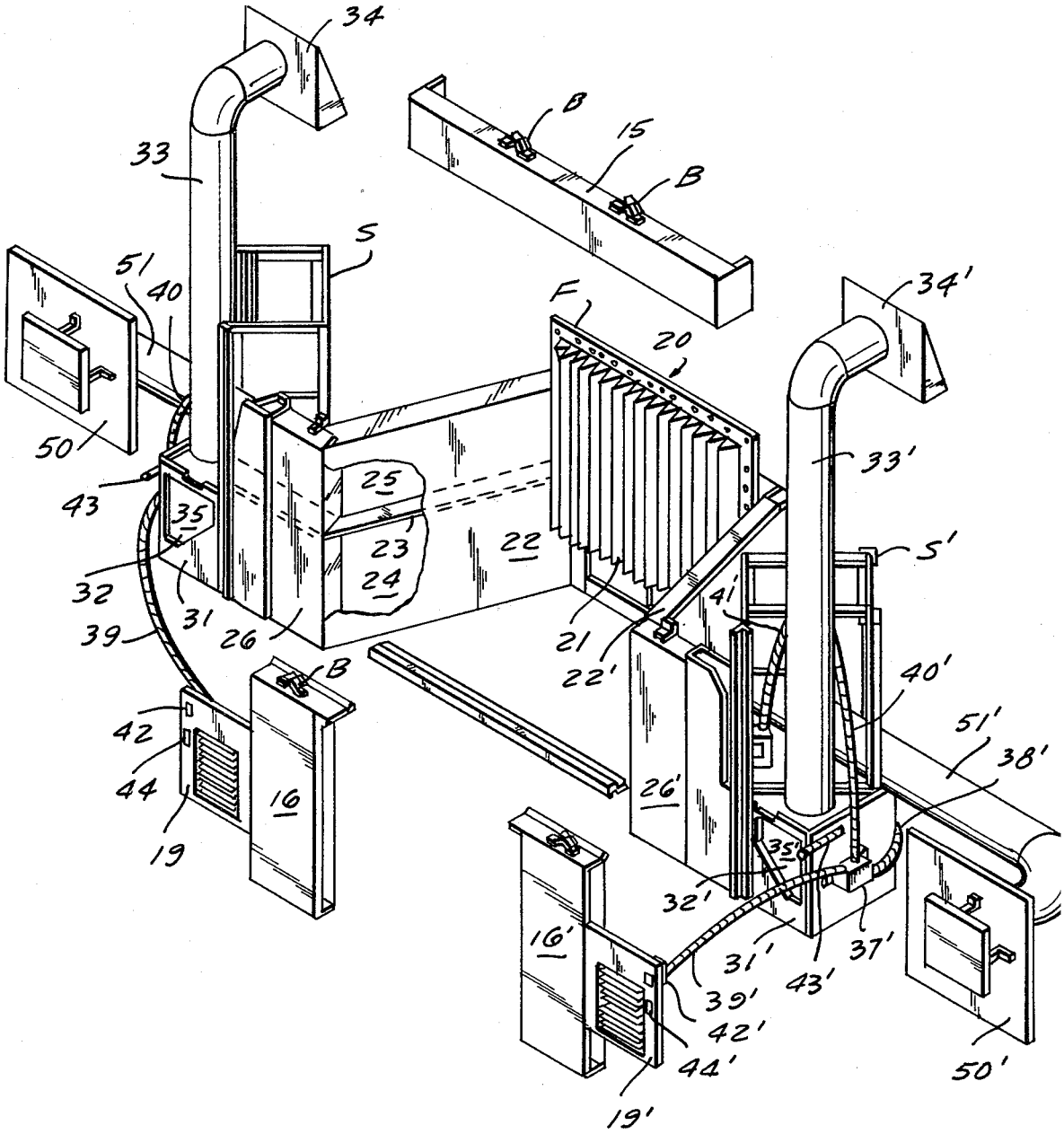
FIG. 2 is a partial exploded isometric view of the form of FIG. 1.

FIG. 2 is a partially exploded isometric view of the form of FIG. 1 with the fireplace removed. More particularly, FIG. 2 illustrates the assembly of insert module 20 and air control means and fan assembly 30, 30'. In this connection, the assembly of FIG. 2 can be constructed as original equipment to be mounted in fireplace 10 or can be made separately for installing into an existing fireplace. Insert module 20 includes a heat exchanger 21 which is coupled in fluid communication to left and right heat exchanger ducts 22, 22'. An air flow divider 23, 23' is positioned between the top and bottom of heat exchanger ducts 22, 22' to provide air inlet ducts or plenums 24, 24' and air outlet ducts or plenums 25, 25'. A vertical baffle is provided within heat exchanger 20 so as to provide left and right air inlet and air outlet ducts 24, 24', 25, 25'. Heat exchanger ducts 22, 22' extend along the left and right side walls respectively, of the fireplace combustion chamber 14. Extending along the left and right front walls of the fireplace are heat exchanger panel extensions 26, 26' which also include the extension of air flow divider 23, 23' to form extension of air inlet ducts 24, 24' and air outlet ducts 25, 25'.

Mounted in fluid communication with the air inlet opening of ducts 24, 24' is air control assembly 30, 30'. Air control assembly 30 includes a blower box or housing 31 having a front opening 32 in which room air may be introduced into air inlet ducts 24, 24'. An opening, not shown, in the top 62 of blower box 31 includes an upright collar or flange 63 to mount fresh air inlet duct 33, 33'. The other end of fresh inlet duct 33, 33' is capped with a cover or louver 34, 34' so that outside air may be introduced into blower box 31, 31' through fresh air inlet duct 33, 33'. Coupled to the blower box 31, 31' is fan means 70, shown in FIG. 4, and may be a squirrel-cage type fan and motor assembly in which the outlet thereof is in fluid communication with air inlet duct 24, 24'. The electrical control means for the fan motor operation and/or damper means 60 includes an electrical utility box 37, 37', flexible conduits 38, 38', 39, 39', 40, 40', 41, 41' which carry the electrical wiring for controlling the fan and/or the damper means 60. The fan switch 42, 42' is mounted on the face of room air inlet grille 19, 19' which covers opening 32, 32'. Also damper control lever 43, 43' of air control assembly 30 is mounted on the blower box 31 and is operatively coupled to the damper mechanism. Damper means 60 may be manually controlled to proportion the amount of fresh air and room air entering inlet ducts 24, 24'. Damper control lever 43, 43' extends through an opening 44, 44' of room air inlet grille 19, 19'.

Outlet grille 50, 50' is mounted in fluid communication with the warm outlet ducts 51, 51' at its remote end to cover warm air discharge opening positioned in a surrounding room adjacent the fireplace. The other end of warm air outlet duct 51, 51' is mounted in fluid tight connection with the outlet opening of outlet duct 25, 25'.

Figure 3:
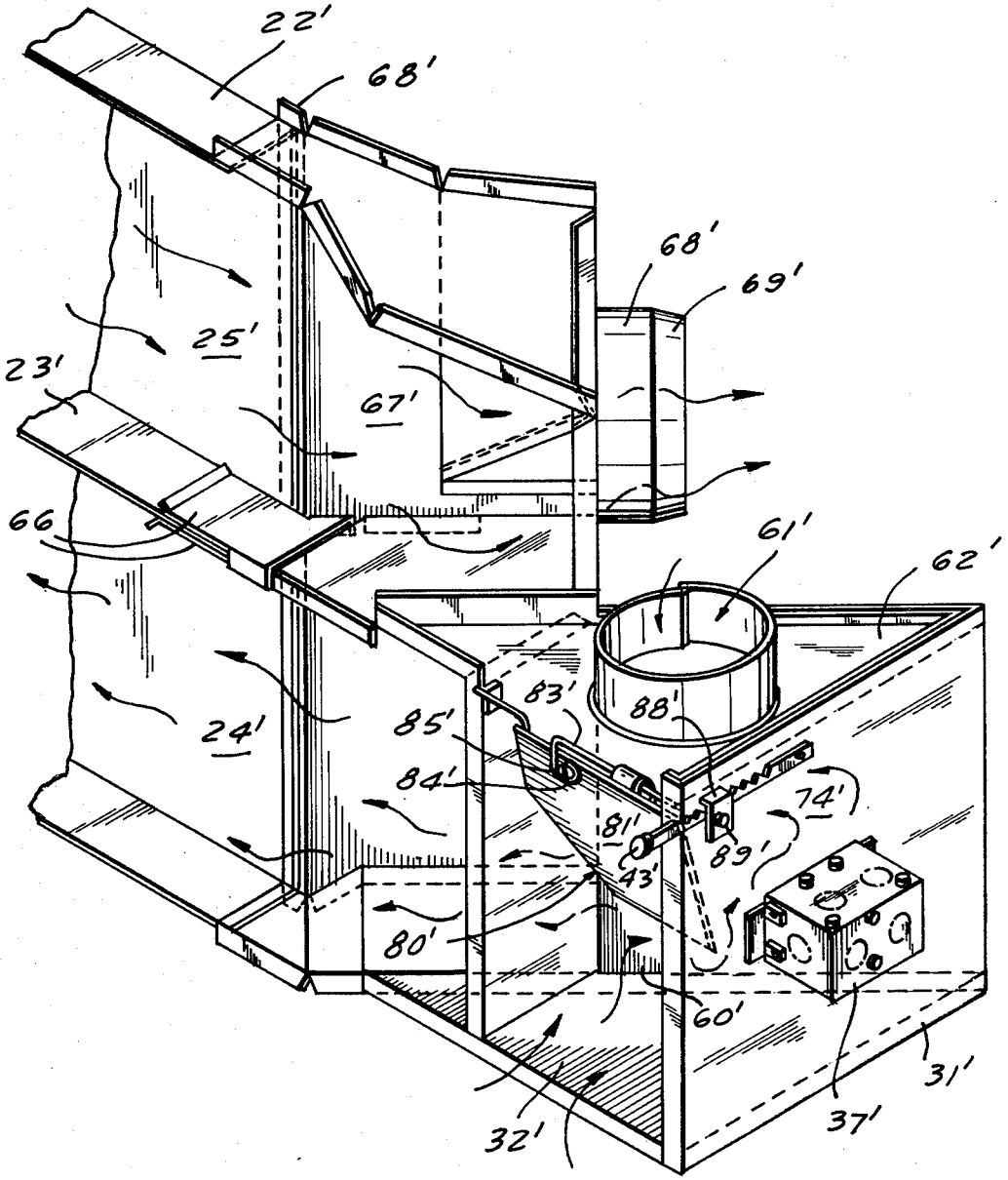
FIG. 3 is an isometric view partially broken away of the air control housing mounted in fluid communication to the air inlet and air outlet ducts of one side of the insert module of FIG. 2.
Figure 4:
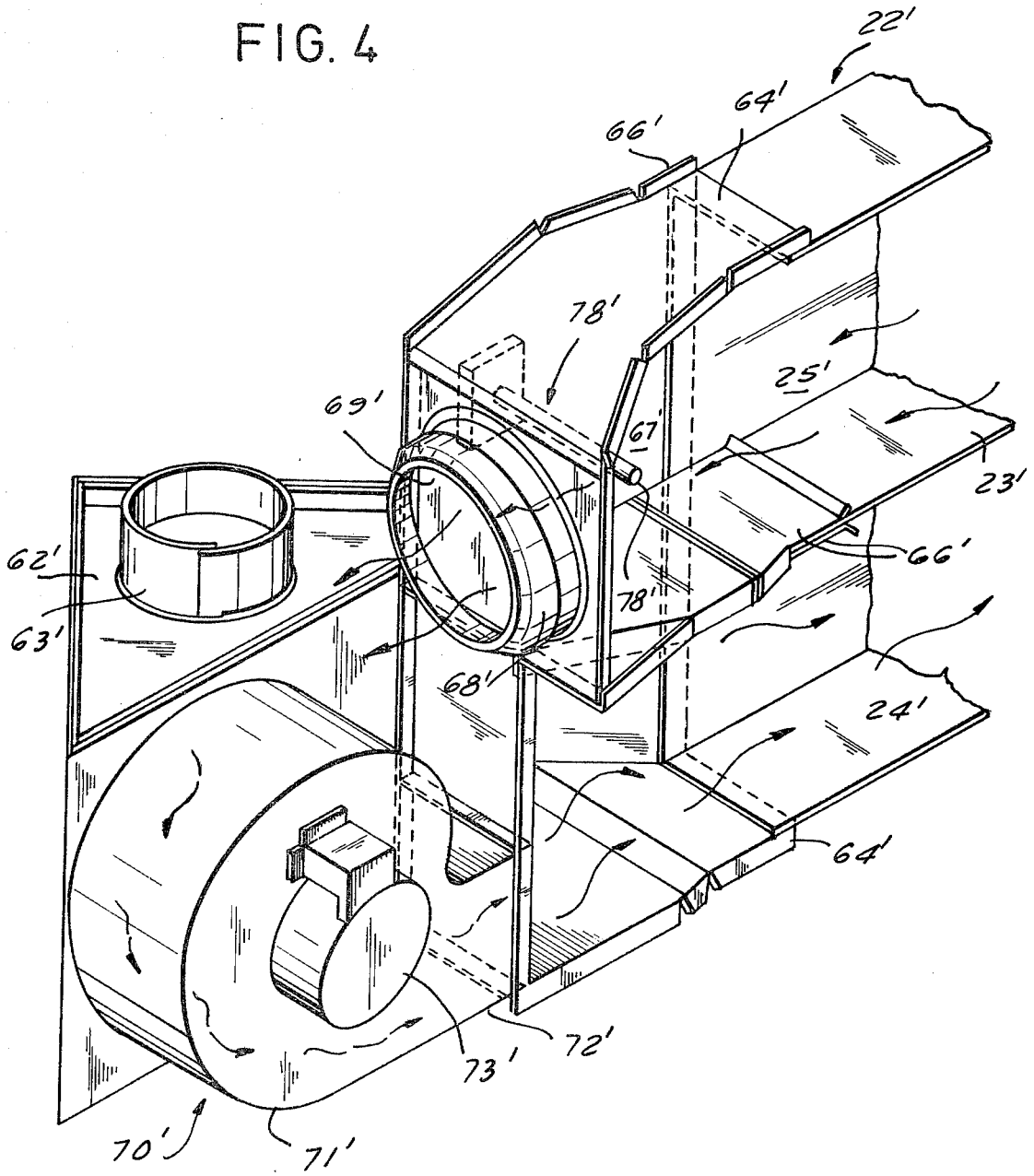
FIG. 4 is an isometric view of the fan assembly mounted in fluid communication with the air control housing and illustrating the air flow path through one side of the insert module of FIG. 2.

FIGS. 3 and 4 illustrate in greatly enlarged isometric view, blower box module of control assembly 30' of FIGS. 1 and 2 with conduits 33' and 51' removed. Blower box module is a multiple compartment box having an air inlet chamber 60' and an air outlet chamber 67'. Chamber 60' is of triangular shape having room air inlet opening 32' disposed in the front face thereof and an outside air inlet opening 61' disposed in the top wall 62'. Opposite the front face of the triangularly formed chamber is a fan opening 74' shown in dotted lines in FIG. 3 for introducing room air and/or outside air entering chamber 60' so that it can be drawn through fan 70' as viewed in FIG. 4. Mounted along the top edge of wall 62' and adapted to cover air inlet openings 32' and 61' is damper assembly 80', shown in exploded isometric view in FIG. 5. As discussed in FIG. 2 fan means 70' is coupled to blower box housing 31' and is a squirrel cage type fan and motor assembly. The inlet side of the fan 70' is in fluid communication with fan opening 74' of air inlet chamber 60'. As shown in FIG. 3 air to be heated is pulled into chamber 60' through air inlet openings 32' and 61' and flows in the direction of the arrows through the fan opening 74'. Thereafter, shown in FIG. 4, air entering the fan is pushed through the outlet opening of the fan housing 71' into the inlet opening of duct 24'. After the air has passed through the heat exchanger means, it is directed outwardly through air outlet chamber 67' from warm air outlet duct 25'.

Mounted in chamber 67' and extending substantially thereacross, as shown in FIG. 4 in dotted lines, is air temperature control means 78'. The temperature control means 78' is a heat sensor which functions as an automatic switch is actuated by the air temperature which causes the switch to open when the air temperature is too low and to close when air temperature is too high. The switch may for example, be coupled to fan and motor assembly 70' which will actuate the motor when the air passing through chamber 67' becomes too hot. Also when the air goes below a predetermined temperature level the switch will open and shut the fan motor to permit the air to be heated to the proper temperature. It is obvious that damper assembly 80' which is shown as a manually operated damper assembly can also be thermostatically controlled through proper electrical controls coupled thereto to proportion the room and outside air entering inlet chamber 60'.

In the form illustrated in FIGS. 3 and 5, air is proportioned manually through the mechanically operated damper assembly 80'. Damper assembly 80' includes a polygonal flat blade or damper 81', and a hand actuating assembly including an axle 82' in the form of an L, one end is mounted on damper surface 81' at its upper edge, as by spot welding so that the other end of axle 82' extends laterally outwardly therefrom to pass through an opening in blower box housing 31'. The end 82' may be threaded to receive a nut to hold end 82' of the damper 81' in position.

As viewed in FIG. 5, damper assembly 80' is arranged and constructed to be operably mounted in blower box housing 31'. Damper blade 81' is hingedly mounted in aligned and opposed openings of blower box housing 31' by rigidly mounted axel 82' and 83'. One end 85' of spring 83' is shaped in the form of a shepard's crook. A rivet 84' is positioned through the formed hook of end 85' and corresponding opening in damper blade 81' to mount spring 83' in position. A bracket 86' having its free end shaped in the form of a hook, is mounted on damper blade 81' to retain spring 83' therein. End 87' of spring 83' extends horizontally from the top damper blade 81' and is aligned with axel 82' so that damper blade 81' is hingedly mounted through aligned openings in blower box housing 31'. As illustrated by the assembly lines of FIG. 5, end 87' is fitted with washers 89' on each side of wall "W" of blower box housing 31'. A bracket 88', also in the form of a hook, is provided with two vertically aligned openings therein with end 87' of spring 83' passing through the opening thereof and fixed into position by nut 97'. Damper handle 43' nests within the hook segment of bracket 88' and is clamped therein by bolt 91' positioned through the top opening of bracket 88' and held in position by washer and nut 92'. Bolt and nut 90' is mounted in opening 94' of damper handle 43' acts as a counterweight to urge damper handle upward to permit teeth 93' to contact the top edge of opening 44 of grille 19'. Bolt and nut 90' also functions as a stop to prevent damper handle 43' from being pulled from bracket 88'.

Bracket 88' fixes the stroke distance that damper handle is permitted to shift for the proper adjustment of damper 81' . When damper handle 43' is moved to its most extended position, that is, away from blower box module 30', damper 81' will cover inlet opening 61' to permit only inside air to enter air mixing chamber 60'. When the damper handle 43' is moved to its innermost position damper 81' will close air inlet opening 32' to permit only outside air to enter air mixing chamber 60'. Any setting of damper handle 43' therebetween will proportion various amounts of inside and outside air entering air mixing chamber 60'. Outside air inlet conduit 33' and warm air conduit 51' are mounted on respective collars 63' and 68' surrounding openings 61' and 69' respectively of blower box module 30'.

Blower box module 30' illustrated in FIGS. 3 and 4 mounted to heat exchanger conduit 22' in fluid communication therewith by laterally extending top and bottom flanges 64' and vertical flanges 68'. A pressure clip assembly 66' fits over the end of air divider 23' of duct 22' and extends laterally from the bottom wall of outlet chamber 67'.

Fan and motor assembly 70' includes a scroll or fan housing 71' having an inlet opening on one side thereof which communicates with the opening formed in the wall of the triangular box. A tangential conduit extends into the air outlet opening of air mixing chamber 60' so that air entering fan and motor assembly 70' will pass through fan housing 71', through tangential conduit 72' and into air inlet duct 24'. Fan motor 73' is provided with a blower mounted for rotation thereon, not shown. As the blower rotates, air is pulled from air mixing chamber 60' through fan housing 71' in the direction of the air flow path arrows, shown in FIG. 4 and discharged tangentially therefrom through tangential conduit 72'. The fan motor 73' is electrically operated through wires contained in the electrical conduits shown in FIG. 2. As shown in FIG. 2 fan motor 73' is electrically operated by fan switch 42'. By manually manipulating switch 42' to its on and off positions, the volume of heated air discharged into the fireplace room or adjacent room may be controlled to maintain a desired air temperature. As indicated above, fan motor 73' may be automatically controlled by temperature control means such as heat sensor 78' which automatically controls the volume of heated air discharged into a room or rooms to maintain a desired temperature.

FIG. 6 illustrates the air inlet grille 19' in front elevation, shown mounted in position in FIG. 1. Formed along the right upper section of the grille is opening 44' to receive damper handle 43'. The openings shown thereabove are for housing indicator lamps such as neon lights 45', 46' which are electrically connected to the heat sensor 78'. When neon light 45' is on, it indicates that fan 73' is in operation and when neon light 46' is on, it indicates that the air temperature is too low and shuts the fan motor 93' off to permit the air in the heat exchanger to rise in temperature. Also, when neon light 46' is on, it may indicate that damper 80' may need adjustment or more fuel is required.

From the foregoing description of the invention, an air control assembly for a heat circulating fireplace capable of controlling the temperature at which air is delivered to a room or rooms has been described. It is obvious that many changes in design, material and arrangement of parts may be had without departing from the invention described herein.

What is claimed:

1. In an air control assembly for a heat circulating fireplace of the type having an insert module provided with an air inlet opening and a heated air discharge opening, is mounted in the combustion chamber of the fireplace, said insert module including a heat exchanger defining the front vertical wall of said insert module which is positioned adjacent the rear wall of the combustion chamber, said air control assembly arranged and constructed to control the temperature of air to be heated that is delivered to said insert module and the temperature of the heated air that is discharged therefrom into the fireplace room and/or an adjacent room, said air control assembly comprising:

a blower box module including a housing having an air inlet mixing chamber and a heated air discharge chamber;

said air inlet mixing chamber having a room air inlet opening and an outside air inlet opening for mixing room air and/or outside air therein;

said heated air discharge chamber having a heated air inlet opening communicating with the heated air outlet opening of said insert module and a heated air outlet opening for discharging heated air into the fireplace room and/or an adjacent room;

said heated air discharge chamber having a temperature control means mounted therein and being in fluid communication with heated air being discharged through said chamber;

a damper assembly is operably mounted on said blower box module and being positioned in said air inlet mixing chamber for proportioning the amount of room air and/or outside air entering said air inlet chamber;

a fan assembly mounted on said blower box housing and having an air inlet opening communicating with the air inlet mixing chamber and an air discharge opening communicating with the air inlet opening of said inert module;

said fan assembly including a fan electrically connected to said temperature control means mounted in said air discharge chamber so that air discharged through the heated air outlet opening of said air discharge chamber is delivered at a preset temperature into the fireplace room and/or adjacent room; and said damper assembly including a damper blade hingedly mounted in said air inlet mixing chamber and being shiftable to cover and uncover said outside air inlet opening to proportion the volume of outside air and inside air entering said air inlet mixing chamber.

2. The air control assembly of claim 1 wherein said damper assembly includes a damper handle coupled to a damper blade.

3. the air control assembly of claim 1 wherein said air temperature control means is a heat sensor mounted in said air discharge chamber and positioned adjacent said heated air outlet opening; said heat sensor being electrically connected to said fan whereby said heat sensor will automatically switch said fan to its on or off position in response to a change in the heated air temperature being discharged from said insert module.

4. The air control assembly of claim 3 wherein temperature control indicating lights are mounted on a grille mounted in overlying relation to said room air inlet opening of said air mixing chamber, said indicator lights being electrically connected to said heat sensor to indicate the discharge temperature of the heated air being delivered to the fireplace room and/or an adjacent room.

* * * * *